US006382056B1

(12) United States Patent
Wu

(10) Patent No.: US 6,382,056 B1
(45) Date of Patent: May 7, 2002

(54) MEANS FOR STABILIZING MOVEMENT OF THE JAW IN AN ADJUSTABLE WRENCH

(76) Inventor: Arthur Wu, Taichung (TW)

( * ) Notice: Subject to any disclaimer, the term of this patent is extended or adjusted under 35 U.S.C. 154(b) by 0 days.

(21) Appl. No.: 09/802,889

(22) Filed: Mar. 12, 2001

(30) Foreign Application Priority Data

Feb. 13, 2001 (TW) ..... 090202137

(51) Int. Cl.[7] ..... B25B 13/16
(52) U.S. Cl. ..... 81/165
(58) Field of Search ..... 81/129, 129.5, 81/165, 170

(56) References Cited

U.S. PATENT DOCUMENTS 2,722,150 A * 11/1955 Green ..... 81/165
4,449,431 A * 5/1984 Brunosson ..... 81/165
5,331,868 A * 7/1994 Elmore ..... 81/165

* cited by examiner

*Primary Examiner*—Joseph J. Hail, III
*Assistant Examiner*—Joni B. Danganan
(74) *Attorney, Agent, or Firm*—Browdy and Neimark, P.L.L.C.

(57) ABSTRACT

An adjustable wrench includes a frame, having a handle, a fixed jaw and a track at one end of the handle. An adjusting worm pivoted to the frame for free rotation. An adjustable jaw, having one end received in the track and meshed with the adjusting worm for moving relative to the fixed jaw upon rotating the adjusting worm. Two spaces defined at the two sides of the adjustable jaw within the track. At least one packing device provided in each of the two spaces, having one end fastened to the adjustable jaw and the other end being against the frame.

20 Claims, 8 Drawing Sheets

MEANS FOR STABILIZING MOVEMENT OF THE JAW IN AN ADJUSTABLE WRENCH

BACKGROUND OF THE INVENTION

The present invention relates to hand tools and, more specifically, to an adjustable wrench.

When operating a conventional adjustable wrench 100, as shown in FIG. 1, the user may hold the adjustable wrench 100 in horizontal, and then rotates the adjusting worm 101 with the thumb to move the adjustable jaw 102 to the desired position. In order to let the adjustable jaw 102 be smoothly moved along the slide rails 104 of the fixed jaw (not shown), a clearance c is left between the slide rails 103 of the adjustable jaw 102 and the slide rails 104 of the fixed jaw. However, the moment produced by the weight w of the adjustable jaw 102 forces the adjustable jaw 102 to incline in one direction, thereby causing one slide rail 103 of the adjustable jaw 102 to attach one slide rail 104 of the fixed jaw. When moving the adjustable jaw 102 at this time, the rails 103 and 104 are rubbed against each other, causing an unstable movement of the adjustable jaw 102. A conventional method of eliminating the aforesaid problem is to reduce the clearance c between the adjustable jaw and the fixed jaw. For example, ASME (The American Society of Mechanical Engineers) B107.8M-1996 defines that the clearance of the adjustable jaw must be as low as within 0.3 mm~0.47 mm. ISO (International Standard Organization) 6786-1982(E) defines that the clearance of the adjustable jaw must be as low as within 0.25 mm~0.36 mm when applying a slight side pressure on the adjustable jaw. The definitions of ISO and ASME do not stop the occurrence of friction between the slide rails of the adjustable jaw and the slide rails of the fixed jaw, i.e., these definitions do not eliminate the aforesaid problem.

SUMMARY OF THE INVENTION

It is one object of the present invention to provide an adjustable wrench, which eliminates friction during movement of the adjustable jaw relative to the fixed jaw.

It is another object of the present invention to provide an adjustable wrench, which prevents the adjustable jaw from trembling in its moving direction when adjusted to the desired position.

To achieve the objects of the present invention, an adjustable wrench is provided comprised of a frame, having a handle, a fixed jaw and a track at one end of the handle. An adjusting worm pivoted to the frame for free rotation. An adjustable jaw mounted in the track and meshed with the adjusting worm and moved relative to the fixed jaw upon rotating the adjusting worm. Two spaces defined at two sides of the adjustable jaw within the track of the frame. At least one packing device provided in each of two spaces for preventing the friction between the side rails of the adjustable jaw and the side rails of the fixed jaw.

DETAILED DESCRIPTION OF THE PREFERRED EMBODIMENT

Figure 1:
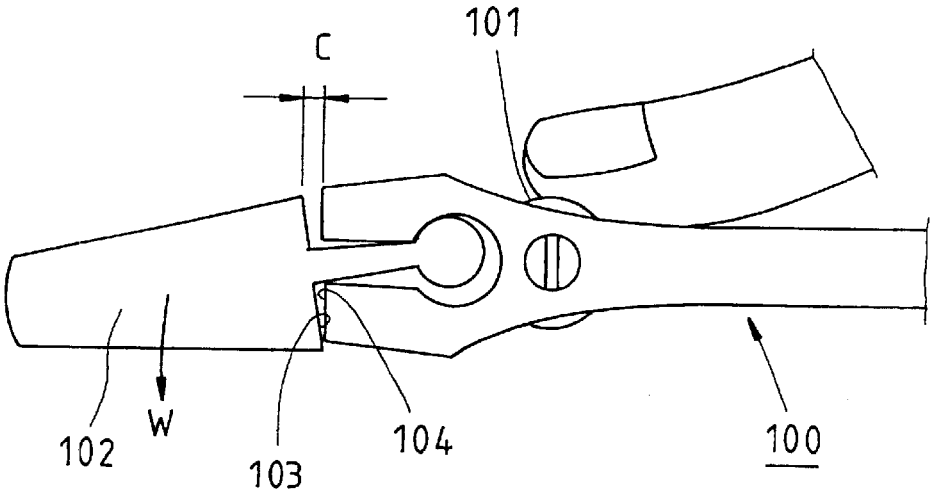
FIG. 1 PRIOR ART
FIG. 1 illustrates an adjustable wrench constructed according to the prior art.
Figure 2:
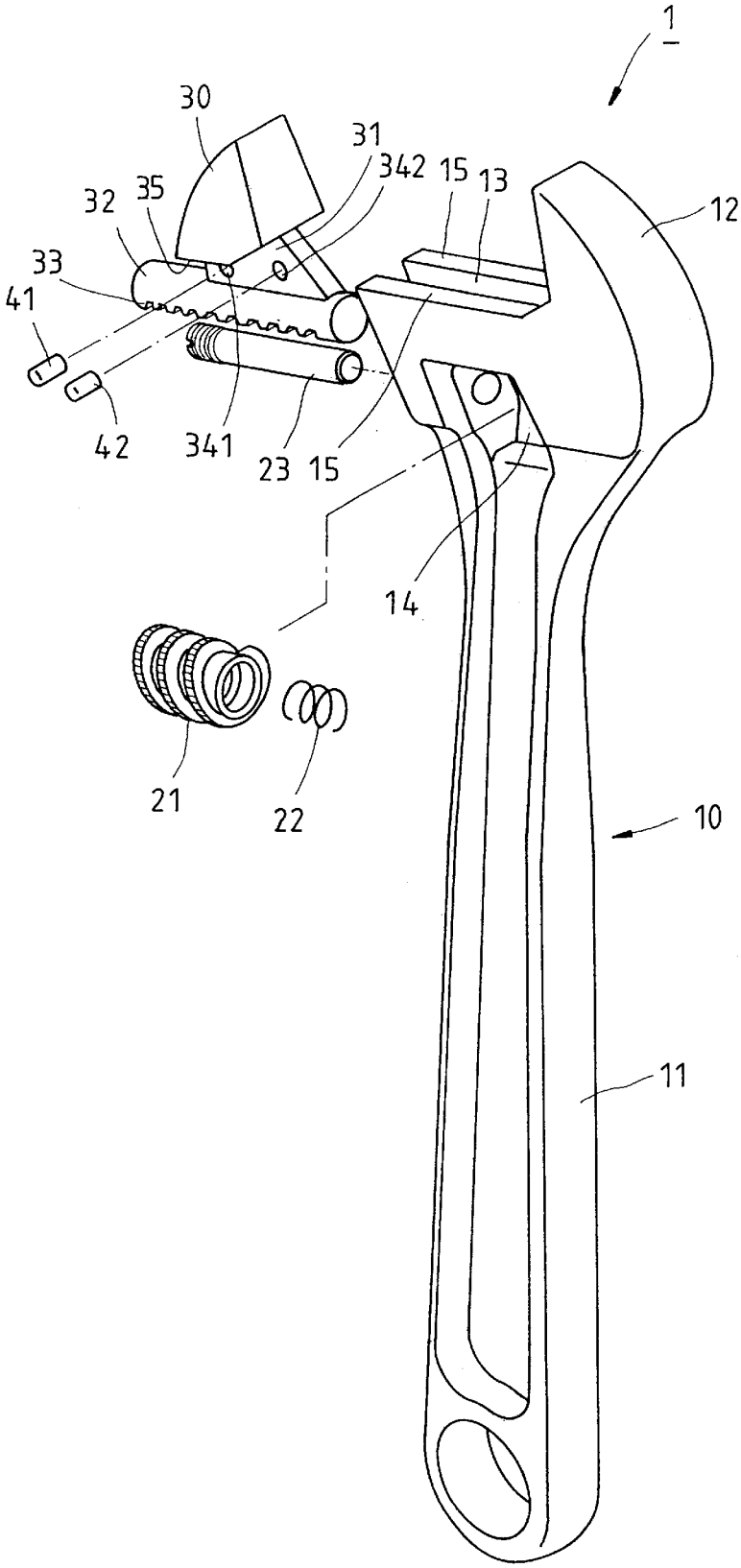
FIG. 2 is an exploded view of an adjustable wrench constructed according to a first embodiment of the present invention.

Referring to FIGS. from 2 through 4, an adjustable wrench 1 in accordance with a first embodiment of the present invention comprises a frame 10, an adjusting worm 21, a worm spring 22, a worm pin 23, an adjustable jaw 30, and two packing devices 41 and 42.

The frame 10 has a handle 11, a fixed jaw 12 at one end of the handle 11, two parallel side rails 15 perpendicularly extended forwards from one side of the fixed jaw 12, a transverse track 13 defined between the rails 15, and an opening 14 disposed below the track 13 and in communication with the track 13. The adjusting worm 21 is pivotally mounted in the opening 14 of the frame 10 by the pivot pin 23. The worm spring 22 is mounted on the pivot pin 23, having one end being against one end of the adjusting worm 21 and the other end being against the frame 10. The adjustable jaw 30 has a bottom neck 31, two through holes 341 and 342 extended through the bottom neck 31, a cylindrical sliding block 32 transversely disposed at the bottom side of the bottom neck 31. The neck 31 and the sliding block 32 of the adjustable jaw 30 received in the track 13 of the frame 10 for enabling the adjustable jaw 30 to be moved along the track 13. A rack 33 provided at the bottom side of the sliding block 32 and meshed with the adjusting worm 21 for enabling the adjustable jaw 30 to be moved in the track 13 upon rotating the adjusting worm 21. Two slide rails 35 disposed at two sides of the neck 31 above the adjusting block 32. After insertion of the neck 31 and sliding block 32 of the adjustable jaw 30 into the track 13 of the frame 10, two spaces 131 and 132 are left at two opposite sides of the neck 31 of the adjustable jaw 30 within the track 13 of the frame 10. The packing devices 41 and 42 are elastic rubber rods of length not shorter than the width of the track 13 of the frame 10. The packing devices 41 and 42 are respectively pressed into the through holes 341 and 342 of the bottom neck 31 of the adjustable jaw 30 with interference fit. Each of the packing devices 41 and 42 have two rounded distal ends respectively suspended in the spaces 131 and 132 and being against the frame 10.

Figure 4:
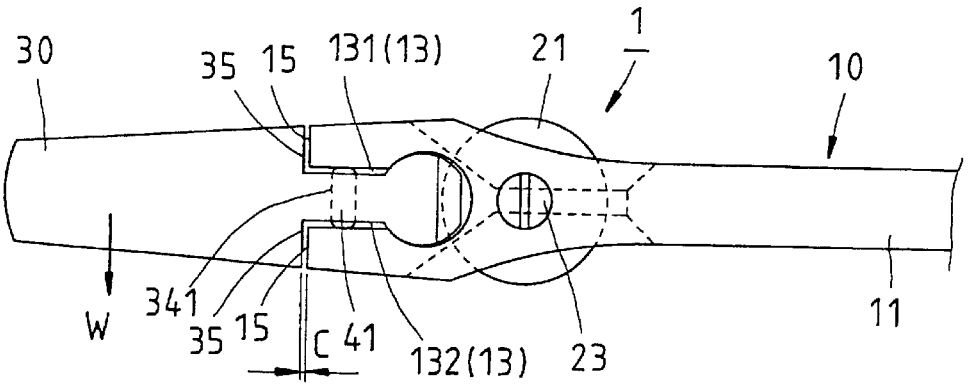
FIG. 4 is a side view of the adjustable wrench according to the first embodiment of the present invention.

Referring to FIG. 4 again, when the user holds the frame 10 of the adjustable wrench 1 in horizontal and rotates the adjusting worm 21 with the thumb. The packing devices 41 and 42 bear the moment produced by the weight W of the adjustable jaw 30, preventing the rails 35 of the adjustable jaw 30 from contacting with the rails 15 of the frame 10. Therefore, no friction is produced between the rails 15 and 35. After long uses, the adjustable jaw 30 can still be moved smoothly and maintained in balance when moving.

Figure 3:
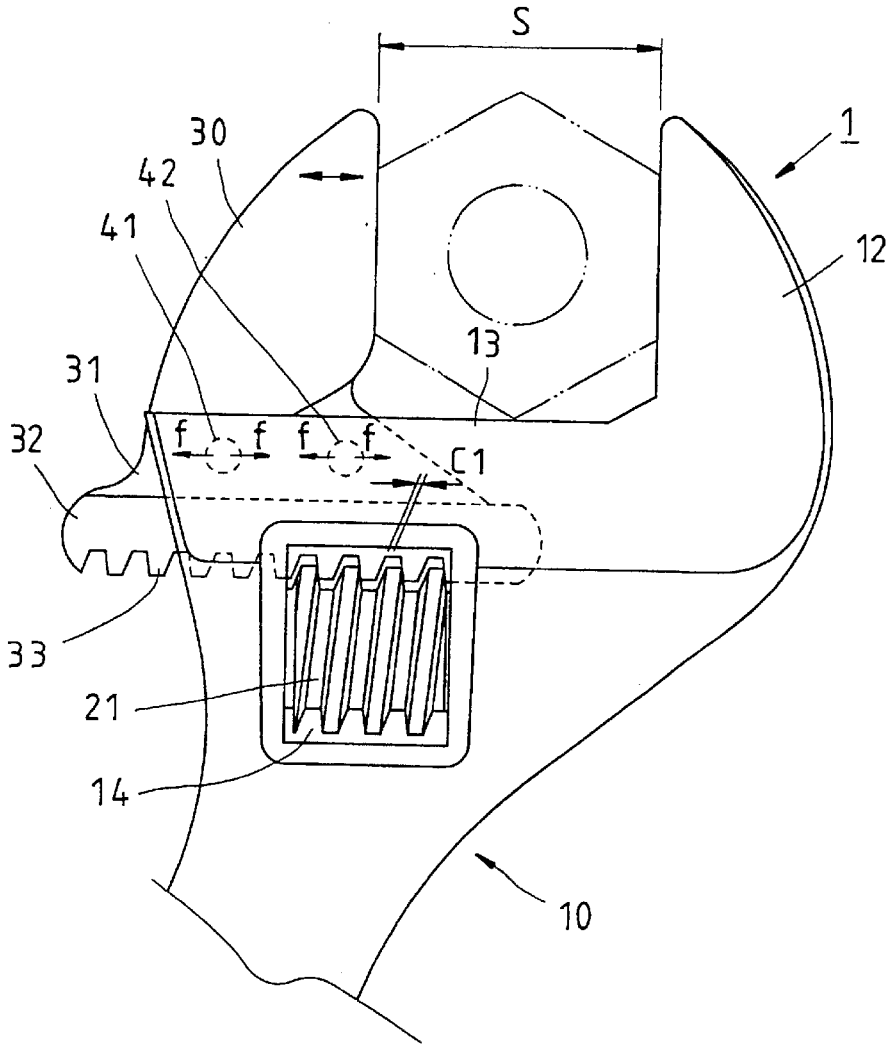
FIG. 3 is a front view of the adjustable wrench according to the first embodiment of the present invention.

Referring to FIGS. 3 and 4 again, because of its adjustability the wrench can be used to rotate different sizes of hexagonal (or square) bolts or nuts. A clearance c1 is produced between the rack 33 of the adjustable jaw 30 and the adjusting worm 21. After the adjustable jaw 30 has been adjusted to the desired position, the clearance cl will cause the adjustable jaw 30 to tremble in its moving direction, resulting a variation of the size s between the fixed jaw 12 and the adjustable jaw 30. If the adjustable jaw 30 trembles, interference will be produced when repeatedly turning the workpiece. The adjustable wrench of the present invention eliminates this problem. This achievement is described hereinafter.

Referring to FIG. 3 again, as stated above, the two distal ends of each of the packing devices 41 and 42 are respectively against the frame 10. After the adjustable jaw 30 has been adjusted to the desired position, a friction force f is produced between the packing devices 41 and 42 and the frame 10. This friction force f can stop the tremble of the adjustable jaw 30 resulted from the clearance c1 between the adjusting worm 21 and the rack 33. In general, the adjustable wrench 1 eliminates friction between the rails 15 of the frame 10 and the rails 35 of the adjustable jaw 30, and provides a friction force to secure the adjustable jaw 30 in position after each adjustment.

Figure 5:
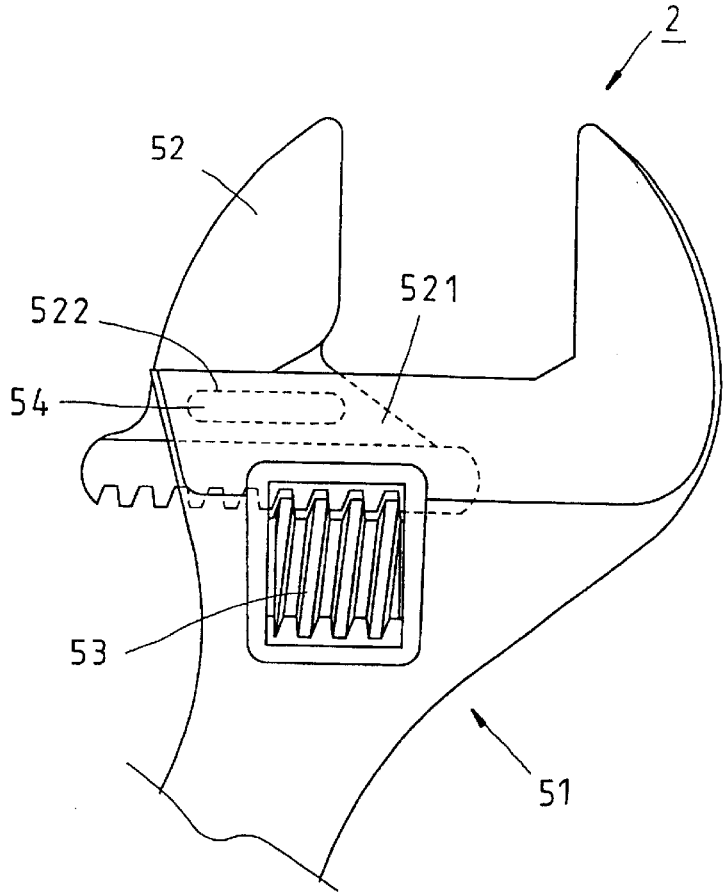
FIG. 5 is a front view of an adjustable wrench constructed according to a second embodiment of the present invention.
Figure 6:
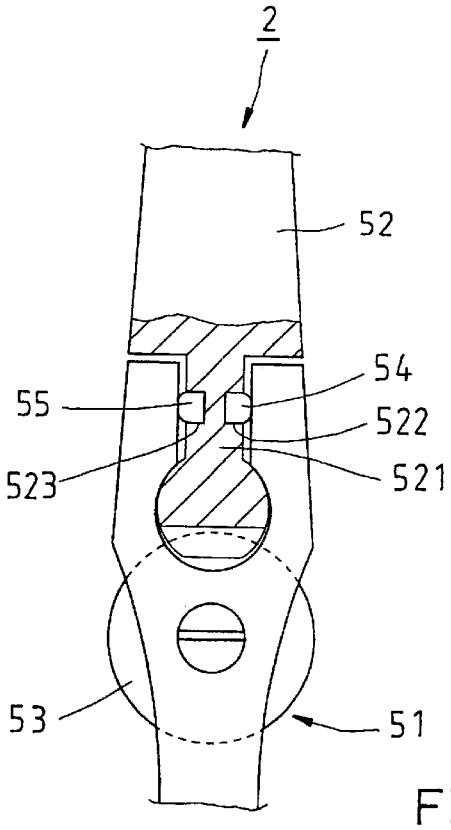
FIG. 6 is a side view of the adjustable wrench according to the second embodiment of the present invention.

Referring to FIGS. 5 and 6, an adjustable wrench 2 according to a second embodiment of the present invention is shown comprised of a frame 51, an adjustable jaw 52, an adjusting worm 53, and two packing devices 54 and 55. Different from the aforesaid first embodiment of the present invention, the bottom neck 521 of the adjustable jaw 52 has two elongated recessed slots 522 at two opposite sides. The packing devices 54 and 55 are coated with a layer of Teflon coating or friction-resisting coating, each having one side engaged into one elongated recessed slot 522 and an opposite side stopped against the frame 10.

Figure 7:
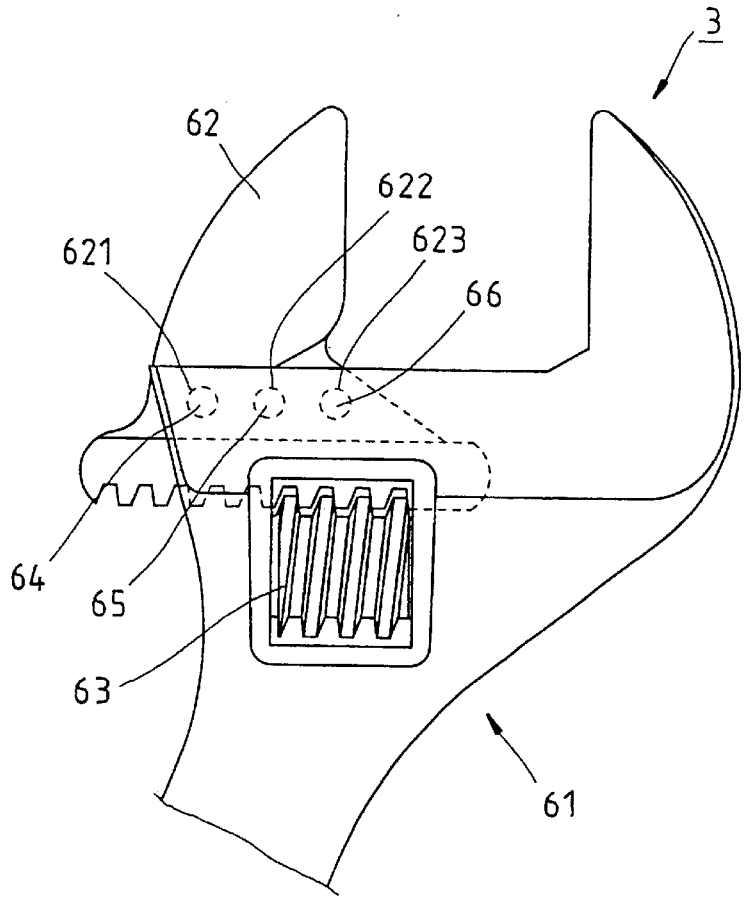
FIG. 7 is a front view of an adjustable wrench constructed according to a third embodiment of the present invention.
Figure 8:
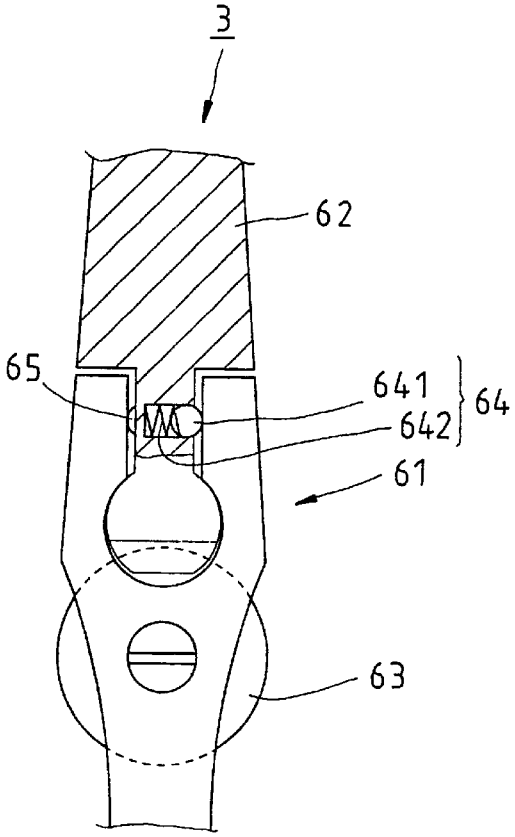
FIG. 8 is a side view of the adjustable wrench according to the third embodiment of the present invention.

Referring to FIGS. 7 and 8, an adjustable wrench 3 according to a third embodiment of the present invention is shown comprised of a frame 61, an adjustable jaw 62 and an adjusting worm 63. The adjustable jaw 62 has two recessed round slots 621 and 622 disposed at one side and one recessed round slot 623 disposed at an opposite side. Three packing devices 64, 65, and 66(in FIG. 8, only one packing device 64 is shown in complete), each of which has a metal ball 641 and elastic member 642 (in this embodiment, the elastic member is a spring). The elastic member 642 is mounted inside the recessed round slot 621. The ball 641 is supported on the elastic member 642, and forced outwards by the elastic member 642 and being against the frame 61.

Figure 9:
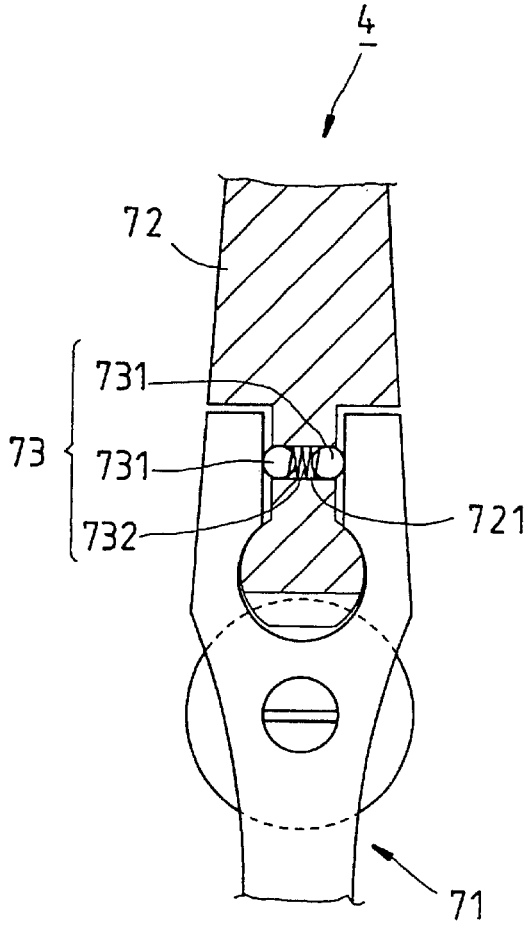
FIG. 9 is a side view of an adjustable wrench constructed according to a fourth embodiment of the present invention.

FIG. 9 shows an adjustable wrench 4 according to a fourth embodiment of the present invention. The adjustable wrench 4 has an adjustable jaw 72, which has two through holes 721 (only one through hole is shown in the drawings), and two packing devices 73 (only one packing device is shown in the drawings) are respectively mounted in the through holes 721. The packing devices 73 each has an elastic member 732, which is a spring, mounted in one through hole 721. Two metal balls 731 respectively supported on the two ends of the elastic member 732 and respectively partially projecting out of the two opposite orifices of the through hole 721 and forced by the elastic member 72 against the frame 71.

In the aforesaid embodiments, each packing device is installed in the adjustable jaw of the adjustable wrench. In practice, the packing devices can be installed in the frame to achieve the same function.

Figure 10:
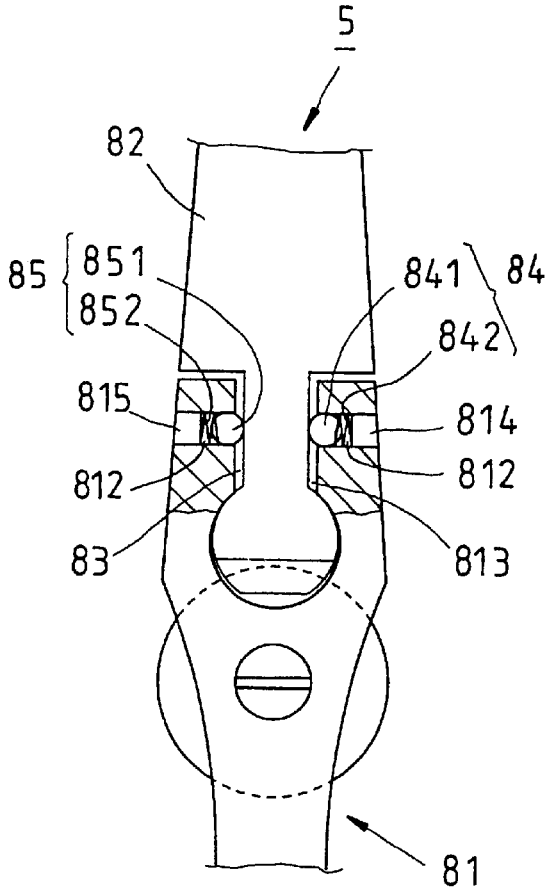
FIG. 10 is a side view of an adjustable wrench constructed according to a fifth embodiment of the present invention.

FIG. 10 shows an adjustable wrench 5 of a fifth embodiment of the present invention. The adjustable wrench 5 has a frame 81, which has two pairs of through holes 811 and 812 (only one of the through holes 811 and 812 are shown in the drawing) disposed in communication with and aligned at two sides of the track 813. Four packing devices 84 and 85 are respectively installed in the through holes 811 and 812 (only two packing devices are shown in the drawing). Similar to the aforesaid third embodiment, the packing devices 84 and 85 each has a metal ball 841 or 851 and a elastic member 842 or 852. After installation of the packing devices 84 and 85 in the through holes 811 and 812, stop elements 814 and 815 are respectively fixedly fastened to the outer end of each of the through holes 811 and 812 to close the through holes 811 and 812 and to stop the respective packing devices 84 and 85 in place. After installation of the stop elements 814 and 815, the outer end of each of the stop elements 814 and 815 is respectively polished and maintained in flush with the outside wall of the frame 81.

Figure 11:
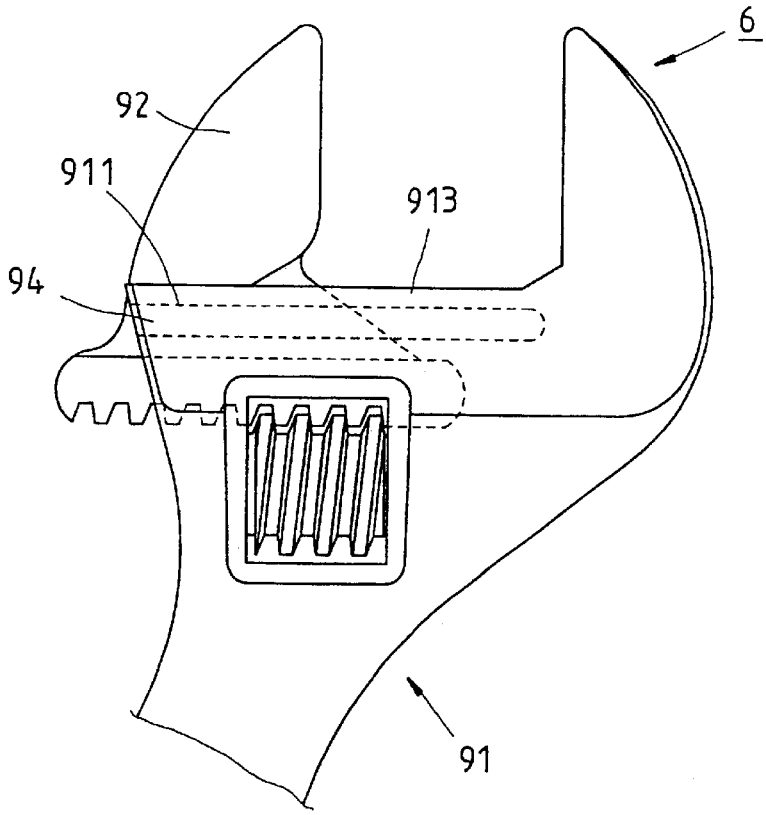
FIG. 11 is a front view of an adjustable wrench constructed according to a sixth embodiment of the present invention.
Figure 12:
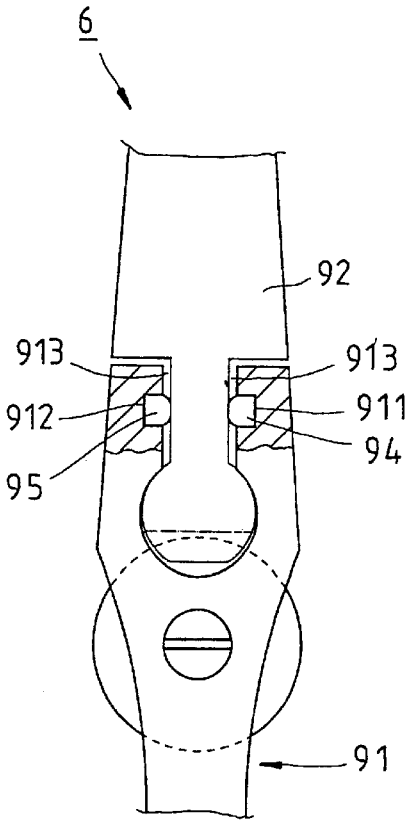
FIG. 12 is a side view of the adjustable wrench according to the sixth embodiment of the present invention.

FIGS. 11 and 12 show an adjustable wrench 6 according to a sixth embodiment of the present invention. According to this embodiment, a frame 91 has two elongated slots 911 and 912 bilaterally disposed in the track 913 and respectively longitudinally extended to the open end of the track 913. Two packing devices 94 and 95 are respectively mounted in the elongated slots 911 and 912 and being against the adjustable jaw 92.

Figure 13:
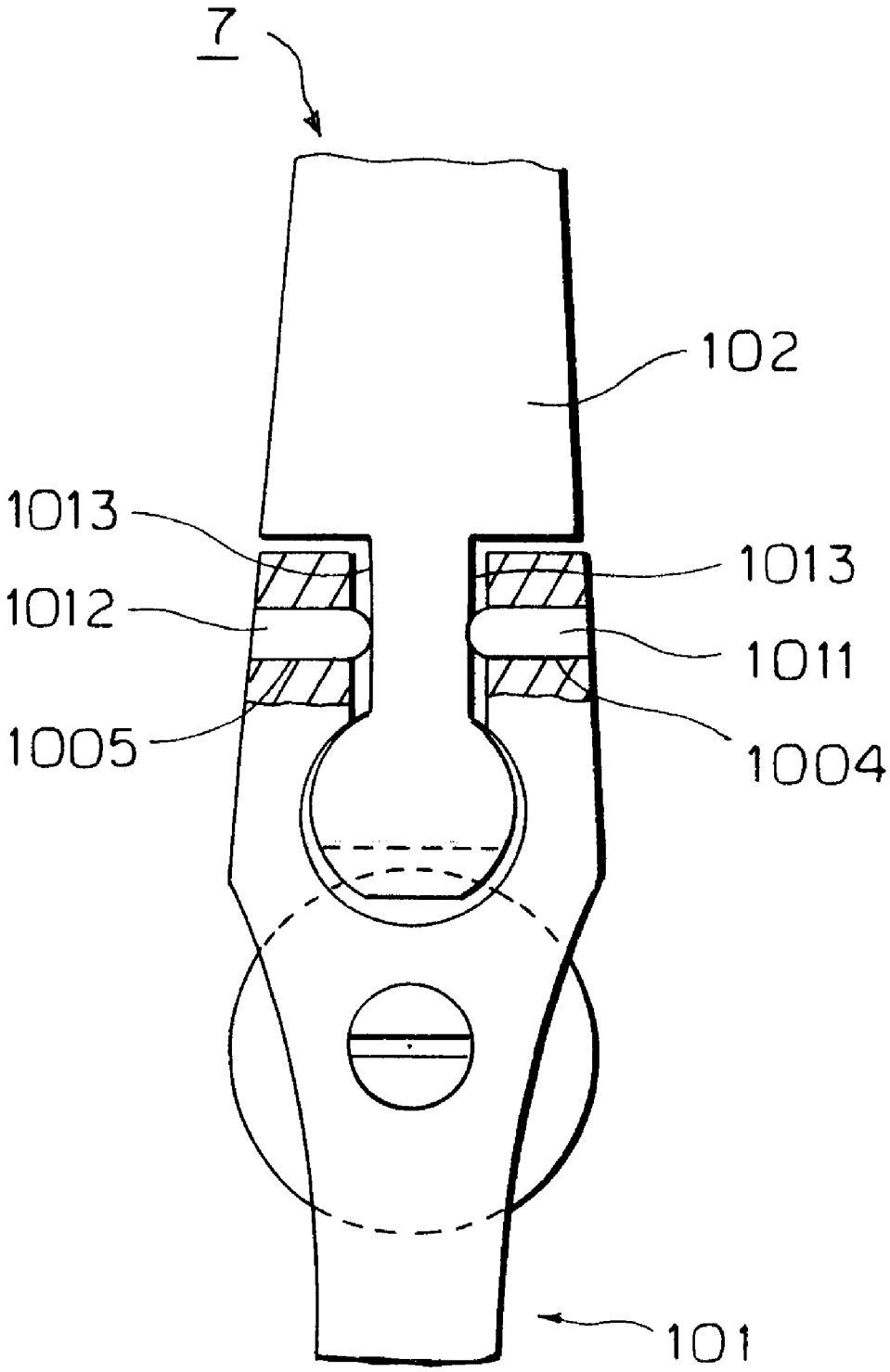
FIG. 13 is a side view of the adjustable wrench according to a seventh embodiment of the present invention.

FIG. 13 shows an adjustable wrench 7 according to a seventh embodiment of the present invention. According to this embodiment, a frame 101 has two through holes 1011 and 1012 disposed in track 1013 two cylindrical elastic members 1004 and 1005 are respectively mounted in the through holes 1011 and 1012 and extend against the, adjustable jaw 102.

A prototype of adjustable wrench has been constructed with the features of the annexed drawings. The adjustable wrench functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An adjustable wrench comprising:

a frame having a fixed jaw and a track at one end thereof;

an adjusting worm rotatably engaged in said frame;

an adjustable jaw having a neck slidably engaged in said track and meshed with said adjusting worm, wherein said adjustable jaw is moveable in said track relative to said fixed jaw when said adjusting worm is rotated;

wherein a space is formed between each side of said neck and each of opposite walls of said track;

at least one through hole provided in said neck; and a packing device fixed in said receiving hole and extending through each said space into engagement with each of said opposing walls;

wherein said packing device is a cylindrical elastic member with ends respectively engaged against said opposite walls.

2. The adjustable wrench of claim 1, wherein said packing device provides a friction resistance between said adjustable jaw and said frame.

3. The adjustable wrench of claim 1, said neck having a sliding block at a bottom thereof slidably engaged in said track.

4. An adjustable wrench comprising:

a frame having a fixed jaw and a track at one end thereof;

an adjusting worm rotatably engaged in said frame;

an adjustable jaw having a neck slidably engaged in said track and meshed with said adjusting worm, wherein said adjustable jaw is moveable in said track relative to said fixed jaw when said adjusting worm is rotated;

wherein a space is formed between each side of said neck and each of opposite walls of said track;

at least one through hole provided in said neck; and a packing device engaged in said through hole and extending through each said space into engagement with each of said opposite walls;

wherein said packing device comprises an elastic member, mounted in said through hole of said adjustable jaw, and two balls, respectively supported on two ends of said elastic member and forced out of said through hole of said adjustable jaw respectively against said opposite walls.

5. The adjustable wrench of claim 4, wherein said packing device provides a friction resistance between said adjustable jaw and said frame.

6. The adjustable wrench of claim 4, said neck having a sliding block at a bottom thereof slidably engaged in said track.

7. An adjustable wrench comprising:

a frame having fixed jaw and a track at one end thereof;

an adjusting worm rotatably engaged in said frame;

an adjustable jaw having a neck slidably engaged in said track and meshed with said adjusting worm, wherein said adjustable jaw is moveable in said track relative to said fixed jaw when said adjusting worm is rotated;

wherein a space is formed between each side of said neck and each of opposite walls of said track;

wherein in said neck comprises at least one recess respectively disposed on each said side thereof; and at least one packing device respectively mounted in each said at least one recess and extending through each said space into engagement with each of said opposite walls.

8. The adjustable wrench of claim 7, wherein said recess is an elongated slot, and said packing device has a friction resisting coating and fits into the elongated slot.

9. The adjustable wrench of claim 7, wherein said recess is a hole and said packing device has an elastic member mounted in said hole and a ball supported on said elastic member forced out of the hole against each of said opposite walls.

10. The adjustable wrench of claim 7, wherein said packing device provides a friction resistance between said adjustable and said frame.

11. The adjustable wrench of claim 7, said neck having a sliding block at a bottom thereof slidably engaged in said track.

12. An adjustable wrench comprising:

a frame having a fixed jaw and a track at one end thereof;

an adjusting worm rotatably engaged in said frame;

an adjustable jaw having a neck slidably engaged in said track and meshed with said adjusting worm, wherein said adjustable jaw is moveable in said track relative to said fixed jaw when said adjusting worm is rotated;

wherein a space is formed between each side of said neck and each of opposite walls of said track;

wherein each of said opposite walls of said track has at least one slot; and at least one packing device mounted in each said slot extending through each space into engagement with a corresponding said side of said neck.

13. The adjustable wrench of claim 12, wherein said slots are elongated and said packing devices have an elongated shape corresponding to said slots.

14. The adjustable wrench of claim 12, wherein said packing device provides a friction resistance between said adjustable jaw and said frame.

15. The adjustable wrench of claim 12, said neck having a sliding block at a bottom thereof slidably engaged in said track.

16. An adjustable wrench comprising:

a frame having a fixed jaw and a track at one end thereof;

an adjusting worm rotatably engaged in said frame;

an adjustable jaw having a neck slidably engaged in said track and meshed with said adjusting worm, wherein said adjustable jaw is moveable in said track relative to said fixed jaw when said adjusting worm is rotated;

wherein a space is formed between each side of said neck and each of opposite walls of said track;

wherein each of said opposite walls of said track has at least one through hole; and at least one packing device mounted in each said through hole extending through each space into engagement with a corresponding said side of said neck.

17. The adjustable wrench of claim 16, wherein each said though hole has a stop element respectively fixedly fastened to an outer end of said through hole; said packing device comprising an elastic member, mounted in said through hole and supported on the stop element, and a ball supported on said elastic member and forced out of the through hole respectively against each said side of said neck.

18. The adjustable wrench of claim 16, wherein said packing device is a cylindrical elastic member having a first end fixed in said through hole and a second end engaged to the corresponding side of said neck.

19. The adjustable wrench of claim 16, wherein said packing device provides a friction resistance between said adjustable jaw and said frame.

20. The adjustable wrench of claim 16, said neck having a sliding block at a bottom thereof slidably engaged in said track.

* * * * *